US009772160B2

(12) United States Patent
Sain

(10) Patent No.: US 9,772,160 B2
(45) Date of Patent: Sep. 26, 2017

(54) FIREARM MAINTENANCE TOOL

(71) Applicant: Sain Defense LLC, Beaumont, TX (US)

(72) Inventor: Brian Keith Sain, Beaumont, TX (US)

(73) Assignee: SAIN DEFENSE LLC, Beaumont, TX (US)

( * ) Notice: Subject to any disclaimer, the term of this patent is extended or adjusted under 35 U.S.C. 154(b) by 0 days.

(21) Appl. No.: 15/005,903

(22) Filed: Jan. 25, 2016

(65) Prior Publication Data

US 2016/0223288 A1 Aug. 4, 2016

Related U.S. Application Data

(60) Provisional application No. 62/112,088, filed on Feb. 4, 2015.

(51) Int. Cl.
*F41A 29/02* (2006.01)
*F41C 27/00* (2006.01)
*F41A 35/00* (2006.01)

(52) U.S. Cl.
CPC ..... *F41C 27/00* (2013.01); *F41A 29/02* (2013.01); *F41A 35/00* (2013.01)

(58) Field of Classification Search
CPC ..... F41A 29/00; F41A 29/02; F41A 29/04; F41A 35/00; F41A 13/00; F41A 13/06; F41A 13/12; F41A 13/10; F41A 5/18; F41A 5/24; F41A 9/65; F41C 9/08; F41C 9/085; F41C 27/00
See application file for complete search history.

(56) References Cited

U.S. PATENT DOCUMENTS 464,099 A * 12/1891 Von Wehrstedt ..... F41A 29/02 15/104.16
1,547,072 A * 7/1925 Silcott ..... F41A 29/02 15/104.165
2,830,398 A * 4/1958 Donohue ..... F41A 9/85 42/59
3,208,302 A * 9/1965 Lewis ..... F41A 29/02 15/104.16

(Continued)

OTHER PUBLICATIONS

Brownells, "John Masen—Mil-Spec Cleaning Kit," http://www.brownells.com/gun-cleaning-chemicals/cleaning-kits/rifle-cleaning-kits/mil-spec-cleaning-kit-prod31870.aspx, Accessed Dec. 15, 2015.

(Continued)

*Primary Examiner* — Derrick Morgan
(74) *Attorney, Agent, or Firm* — Bennet K. Langlotz; Langlotz Patent & Trademark Works, Inc.

(57) ABSTRACT

A firearm maintenance tool has a body including a rail mount segment and a spindle rotatably mounted to the body and adapted to receive an elongated cleaning rod. The tool may include a square drive element adapted to engage a tool socket. The body may be an elongated body, and the rail segment may extend the length of the body. The body may be an elongated body defining a body axis, and the spindle may extend perpendicularly from the body along a spindle axis perpendicular to the body axis. The body may define a first aperture receiving the spindle, and a second aperture receiving a retention element operably securing the spindle to the body. The first and second apertures may be perpendicular to each other.

15 Claims, 9 Drawing Sheets

(56) References Cited

U.S. PATENT DOCUMENTS 3,609,790 A * 10/1971 Butch ..... F41A 29/02 15/104.165
4,056,020 A * 11/1977 Coviello ..... B25G 1/066 81/177.2
4,321,765 A * 3/1982 Gillum ..... F41C 23/10 42/72
4,509,223 A * 4/1985 Sipple ..... F41A 29/00 15/145
4,579,037 A * 4/1986 Gillum ..... F41A 3/62 42/72
4,735,008 A * 4/1988 Williams ..... F41C 23/10 42/71.02
4,899,415 A * 2/1990 Wheeler ..... F41A 29/02 15/104.05
4,946,202 A * 8/1990 Perricone ..... F16C 11/106 174/86
4,984,515 A * 1/1991 Pivonka ..... A47J 37/0786 108/64
5,016,380 A * 5/1991 Jones ..... B25F 1/02 42/90
5,022,176 A * 6/1991 Frigon ..... F41A 29/02 42/90
5,052,143 A * 10/1991 Ryan ..... F41C 27/00 29/239
5,075,998 A * 12/1991 Selleck ..... F41A 29/02 15/104.2
5,169,999 A * 12/1992 Jenkins ..... F41C 9/085 42/90
5,404,666 A * 4/1995 Cline, Jr. ..... F41A 29/02 42/90
5,446,987 A * 9/1995 Lee ..... F42B 12/34 42/61
5,557,871 A * 9/1996 LaLonde ..... F41A 29/02 15/104.165
6,145,235 A * 11/2000 Emerson ..... F41C 9/085 42/51
6,606,925 B1 * 8/2003 Gmeilbauer ..... B25B 13/461 81/177.1
8,063,293 B1 * 11/2011 Kjellgren ..... G10D 13/006 84/422.1
2001/0034961 A1 * 11/2001 Hickerson ..... F41A 29/02 42/70.11
2006/0005446 A1 * 1/2006 Lee ..... F41C 9/08 42/90
2010/0282066 A1 * 11/2010 Tankersley ..... F41A 5/26 89/193
2011/0035983 A1 * 2/2011 Conti ..... F41A 11/00 42/90
2011/0173862 A1 * 7/2011 Williams ..... F41C 27/00 42/72
2011/0209379 A1 * 9/2011 Williams ..... F41A 29/02 42/95
2011/0239515 A1 * 10/2011 Tennyson ..... F41A 29/02 42/95
2011/0302818 A1 * 12/2011 Samaras ..... F41C 9/085 42/90
2012/0152104 A1 * 6/2012 Audibert ..... F41A 5/18 89/191.01
2013/0047483 A1 * 2/2013 Horne ..... F41C 27/00 42/90
2013/0061507 A1 * 3/2013 Hunsaker ..... F41C 9/08 42/90
2013/0104442 A1 * 5/2013 Hancharick ..... F41C 9/085 42/90
2013/0111799 A1 * 5/2013 Lee et al. ..... F41G 11/001 42/106
2014/0150318 A1 * 6/2014 Engesser ..... F41A 21/481 42/75.02
2014/0223795 A1 * 8/2014 Ransom ..... F41A 35/00 42/90
2015/0097094 A1 * 4/2015 Hartness ..... F41A 29/02 248/126
2016/0202015 A1 * 7/2016 Poehlman ..... F41A 35/00 42/90
2016/0223288 A1 * 8/2016 Sain ..... F41C 27/00
2016/0279685 A1 * 9/2016 Marvin ..... F41A 29/02

OTHER PUBLICATIONS

Brownells, "Daniel Defense—AR-15/M16 Vertical Grip," http://www.brownells.com/rifle-parts/grip-parts/vertical-grips/ar-15-m16-vertical-grip-prod75112.aspx, Accessed Dec. 15, 2015.

* cited by examiner

FIREARM MAINTENANCE TOOL

CROSS-REFERENCE TO RELATED APPLICATION

This application claims the benefit of U.S. Provisional Patent Application No. 62/112,088 filed on Feb. 4, 2015, entitled "SAIN (Sniper And INfantry) Cleaning Rod," which is hereby incorporated by reference in its entirety for all that is taught and disclosed therein.

FIELD OF THE INVENTION

The present invention relates to firearms, and more particularly to a firearm maintenance tool that interfaces with a portable cleaning rod and provides a tool drive capability.

BACKGROUND OF THE INVENTION

Human combat is the ultimate proving ground for equipment design and function. Lives depend on the durability and functionality of an infantryman's equipment. Proper equipment and the maintenance thereof is a key factor in mission success or failure. Firearms used in combat or in remote hunting locations are extremely susceptible to having their barrel bores clogged with mud or debris. Worse, a cartridge case swollen under pressure inside a hot, dirty firearm cartridge chamber, or a projectile, bore brush or broken piece of cleaning rod stuck in the bore of a firearm, will render the firearm useless until the obstruction is removed. These are critical situations for combat troops. Firearm bores can become so hopelessly obstructed that the obstruction must be forcefully driven from the bore with a cleaning rod. This situation presents multiple problems when utilizing ad hoc, traditional or even most commonly available tactical weapon cleaning equipment.

Precision firearm cleaning rods are often constructed of a single piece of steel or stainless steel and are impractical to carry in combat because of their excessive length and the weak construction of their handles, which are not designed to withstand the abuse and corrosion commonly associated with exposure to the elements and/or combat. Furthermore, most precision cleaning rods are made of a single length of spring steel coated with a polymer coating, or are made of uncoated stainless steel or carbon fiber. All three types present problems unique to each in a combat or remote hunting environment. The polymer coating on the coated rods is susceptible to having sand embedded into the coating. Sand is harder than bore steel, and the embedded sand creates an "emery board" effect, damaging the bore of the firearm. The uncoated stainless steel rods are impervious to sand embedding; however, they are prone to peen the lands of the bore as the rod flexes while traveling down the bore. Carbon fiber rods will not withstand the force required to physically drive out a critical bore obstruction.

Commonly available take down or sectional cleaning rods are often constructed of steel, stainless steel, brass, or aluminum. However, the section joints are often weak and frequently break. When this occurs while the rod is inside the bore of a firearm, a section of cleaning rod (sometimes with a bore brush attached) also becomes stuck in the bore, thereby compounding the problem. Furthermore, the section joints of many sectional cleaning rods are often poorly machined to imprecise tolerances and often mismatch where they join. This creates a "file effect," thereby damaging the bore of the firearm. Additionally, changing directions before a cleaning brush has exited the bore will often cause a critical bore obstruction requiring force to clear.

In addition, traditional cleaning rod handles are not designed to be treated roughly, much less struck with enough force to clear a critical bore obstruction. Often, if the user uses his or her hand to strike the rear portion of the cleaning rod handle with enough force to dislodge a critical bore obstruction; the rod itself can be driven through the handle and into the user's hand, thereby damaging the rod, injuring the user, and still possibly not clearing the bore obstruction.

Size and weight are also critical factors for war fighters and hunters in remote locations who must carry all equipment with them with little or no chance of re-supply. Excessive weight is undesirable, and multi-function equipment yields both space and weight savings, saving the war fighter or hunter physical exertion. These are lifesaving issues in combat and remote hunting scenarios. Bore snakes and bore cables were created to solve the size and weight issues, but lack the rigidity and strength required to remove a critical bore obstruction.

Having the proper equipment immediately accessible to maintain the warfighter or hunter's weapon/firearm is vital to the success of a combat mission or hunt. In a critical bore obstruction situation, the first priority for the warfighter or hunter is to clear the bore obstruction so that the weapon is again operable. Secondly, this must be accomplished without damaging the firearm, which is often very expensive. Thirdly, the maintenance equipment must be easily and compactly carried and secured against loss afield.

Although firearms cleaning kits firearm cleaning devices of both rigid and flexible designs have been designed and offered for both civilian and military applications that address common firearms maintenance and cleaning requirements under normal circumstances, users often experience difficulty utilizing these kits successfully when addressing critical bore obstructions in combat or extreme hunting circumstances, ultimately finding them severely lacking, if not unusable. In some instances, substandard cleaning equipment compounds an already critical bore obstruction situation. A critical bore obstruction requires specialized equipment and forceful action to resolve.

Therefore, a need exists for a new and improved firearm maintenance tool that interfaces with a portable cleaning rod and provides a tool drive capability. In this regard, the various embodiments of the present invention substantially fulfill these needs. In this respect, the firearm maintenance tool according to the present invention substantially departs from the conventional concepts and designs of the prior art, and in doing so provides an apparatus primarily developed for the purpose of interfacing with a portable cleaning rod and providing a tool drive capability.

SUMMARY OF THE INVENTION

The present invention provides an improved firearm maintenance tool, and overcomes the above-mentioned disadvantages and drawbacks of the prior art. As such, the general purpose of the present invention, which will be described subsequently in greater detail, is to provide an improved firearm maintenance tool that has all the advantages of the prior art mentioned above.

To attain this, the preferred embodiment of the present invention essentially comprises a body including a rail mount segment and a spindle rotatably mounted to the body and adapted to receive an elongated cleaning rod. The tool may include a square drive element adapted to engage a tool socket. The body may be an elongated body, and the rail segment may extend the length of the body. The body may be an elongated body defining a body axis, and the spindle may extend perpendicularly from the body along a spindle axis perpendicular to the body axis. The body may define a first aperture receiving the spindle, and a second aperture receiving a retention element operably securing the spindle to the body. The first and second apertures may be perpendicular to each other. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
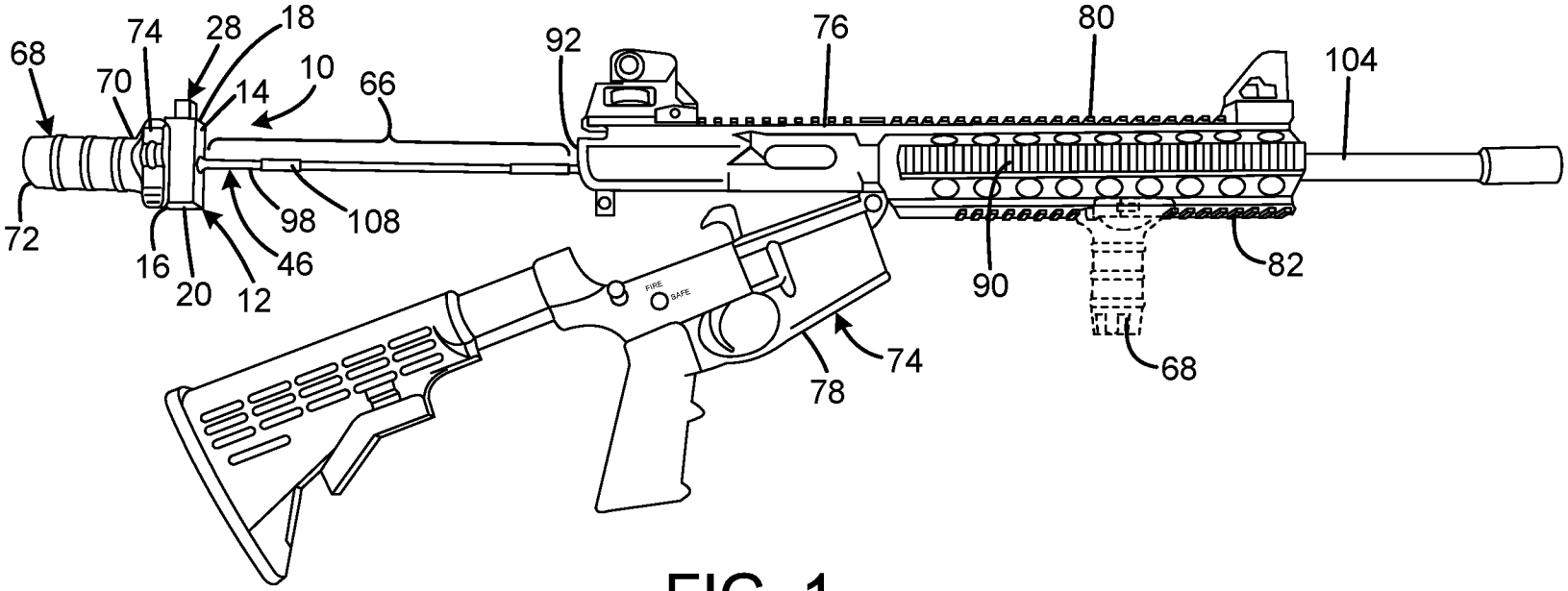
FIG. 1 is a right side view of the current embodiment of the firearm maintenance tool constructed in accordance with the principles of the present invention in use clearing a bore obstruction from a rifle.
Figure 2:
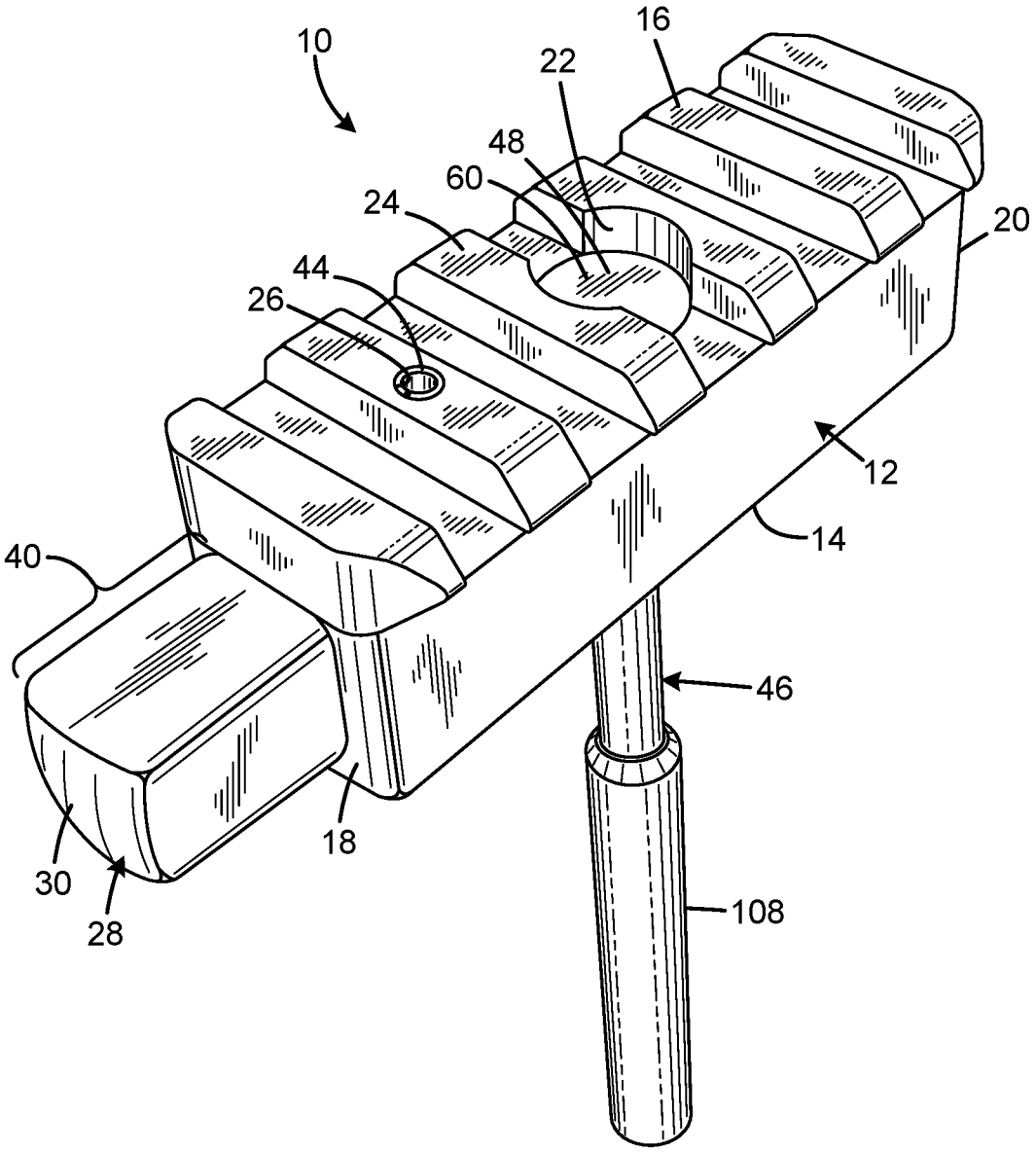
FIG. 2 is a bottom perspective view of the current embodiment of the firearm maintenance tool of FIG. 1.
Figure 2A:
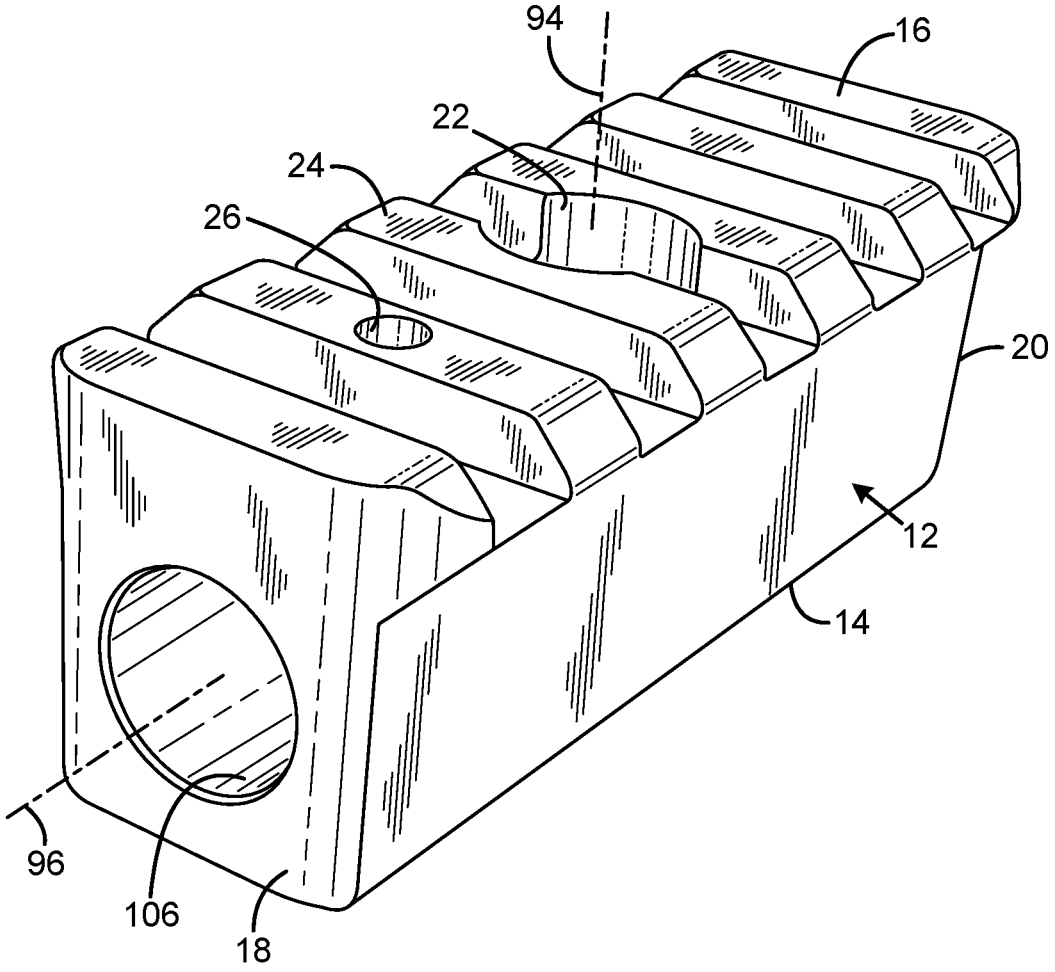
FIG. 2A is a bottom perspective view of the current embodiment of handle of the firearm maintenance tool of FIG. 1.
Figure 3:
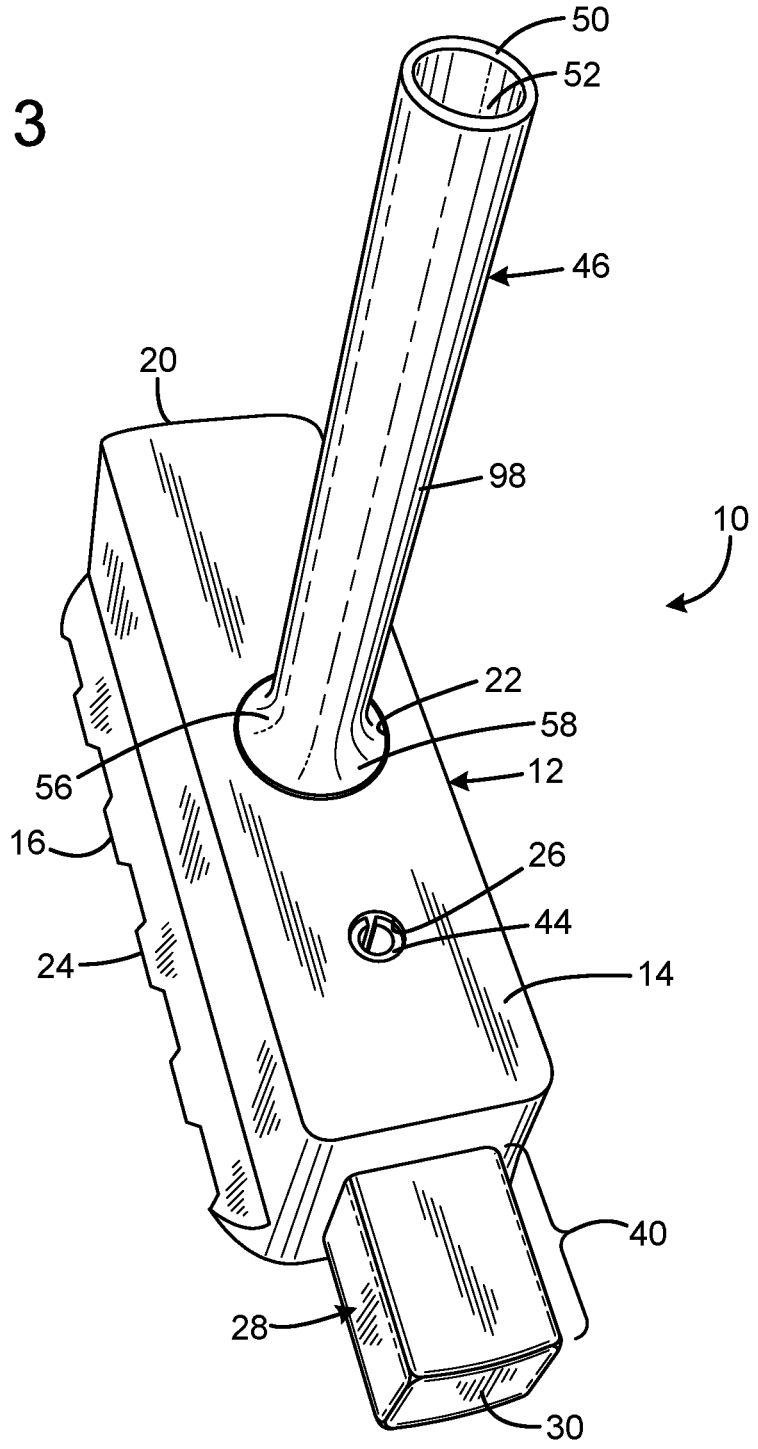
FIG. 3 is a top perspective view of the current embodiment of the firearm maintenance tool of FIG. 1.
Figure 4:
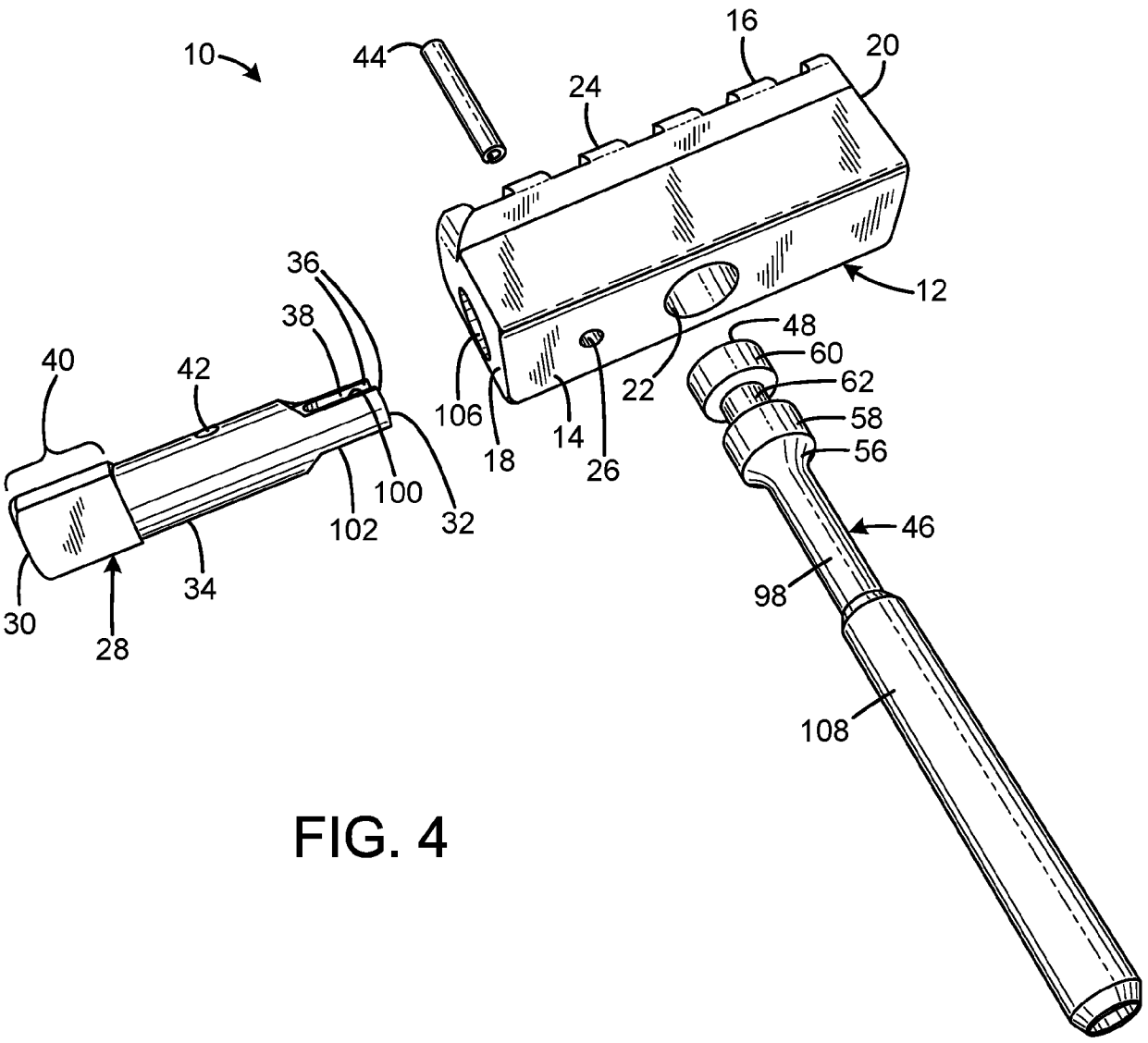
FIG. 4 is an exploded view of the current embodiment of the firearm maintenance tool of FIG. 1.
Figure 5:
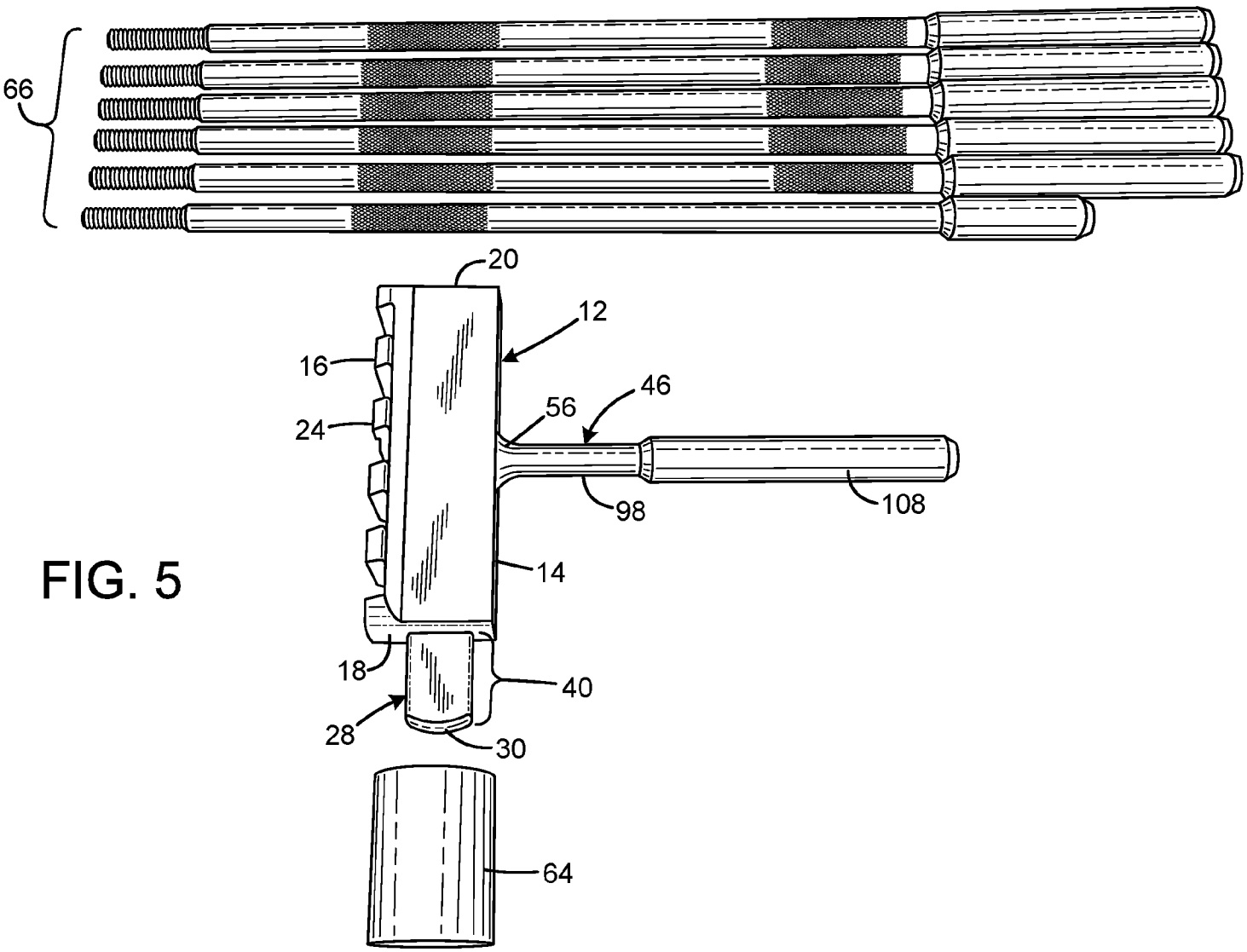
FIG. 5 is a side view of the current embodiment of the firearm maintenance tool of FIG. 1.
Figure 6:
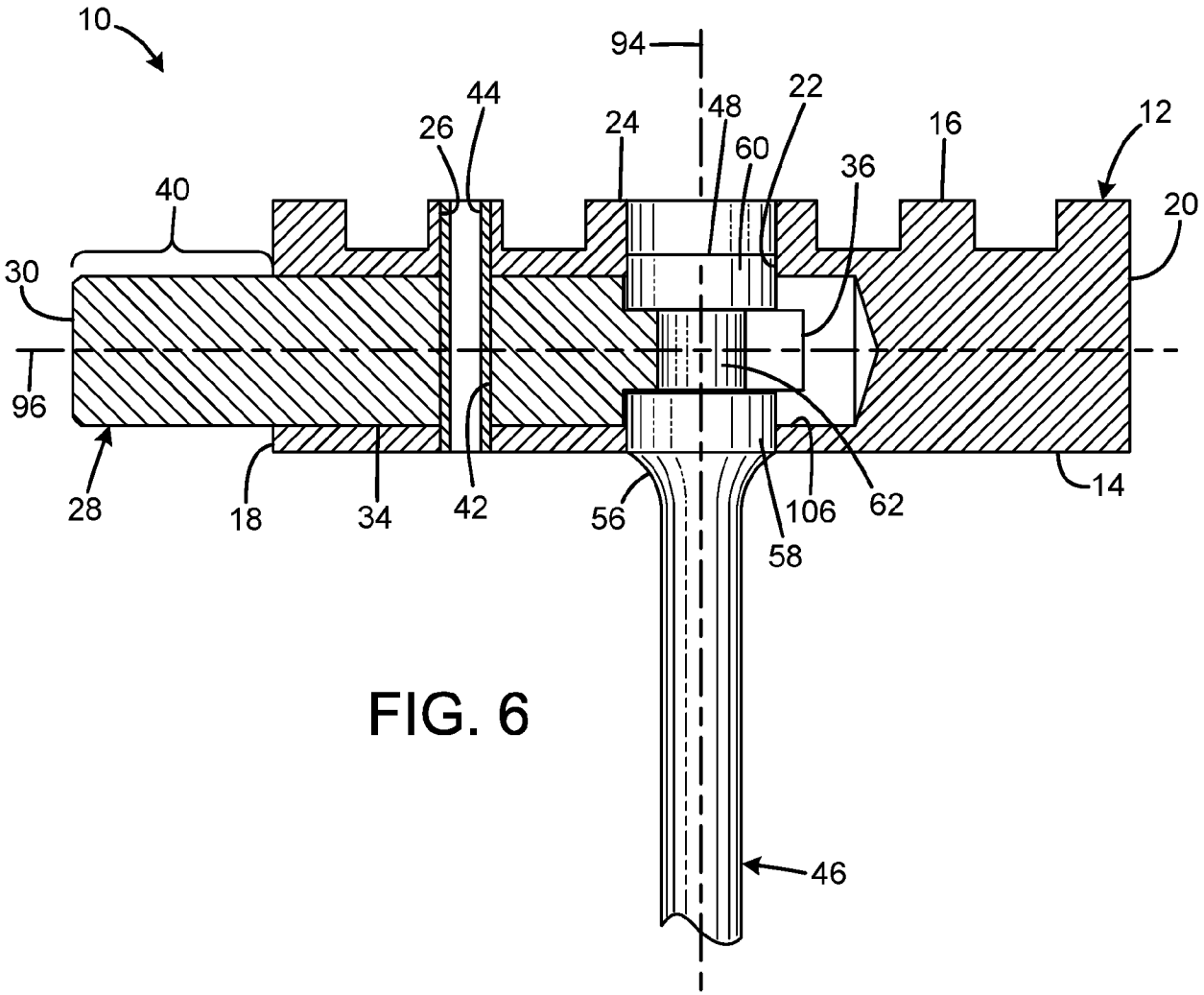
FIG. 6 is a side sectional fragmentary view of the current embodiment of the firearm maintenance tool of FIG. 1.
Figure 7:
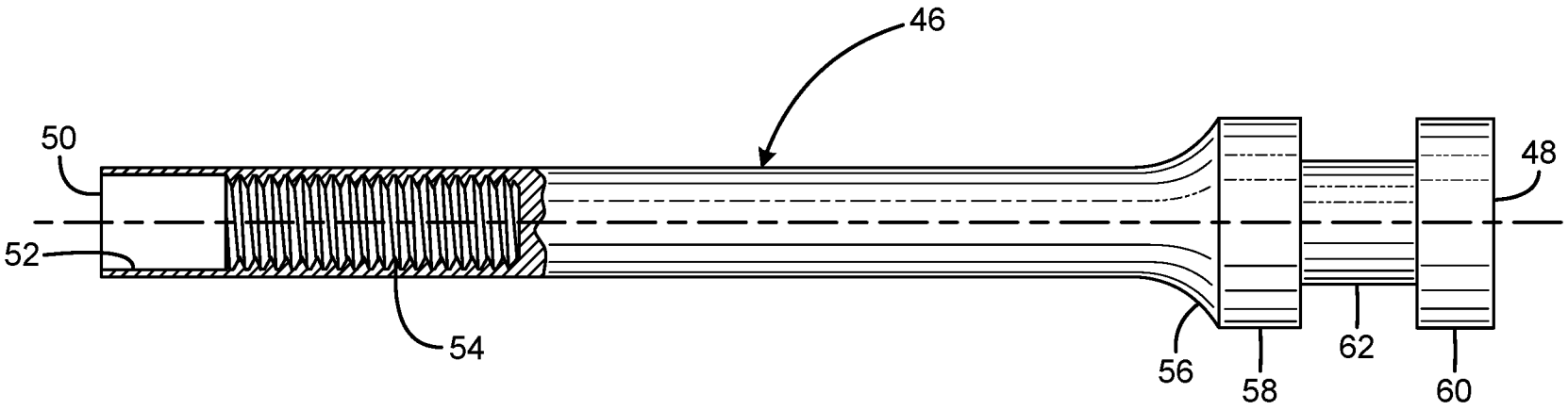
FIG. 7 is a side view of the current embodiment of the rotating spindle of the firearm maintenance tool of FIG. 1.

An embodiment of the firearm maintenance tool of the present invention is shown and generally designated by the reference numeral 10.

FIGS. 1-7 illustrate the improved firearm maintenance tool 10 of the present invention. More particularly, in FIG. 1 the firearm maintenance tool is depicted in an assembled state clearing a bore obstruction from a rifle 74. The rifle has an upper receiver 76, a lower receiver 78, an upper Picatinny rail 80, a lower Picatinny rail 82, a right side 90, and a rear 92. During normal operation of the rifle, a vertical handgrip 68 having a top 70 and a bottom 72 is attached by a rail clamp 74 to the lower Picatinny rail to provide a forward grip position on the rifle for a user.

The firearm maintenance tool has an elongated handle body 12 having a top 14, bottom 16, front 18, and rear 20. The bottom includes a Picatinny rail segment 24 that extends the length of the body. The embodiment comprising the rod handle body is comprised primarily of a section of accessory rail that is commonly known as MIL-STD-1913 or Picatinny Rail, but could also be substituted by other embodiments including, but not limited to the following commonly known accessory rail types: STANAG 2324 Rail, STANAG 4694 Rail, NATO Accessory Rail, Weaver Rail, Scope Rail, Tactical Rail, Modular Accessory Rail, Accessory Rail, Rail Interface System (RIS), Rail Accessory System (RAS), KeyMod, KeySlot, M-LOK and ARC LOK. It is conceivable that a substitute rail could be adapted or fashioned that does not fall into the categories listed above, but utilizes the same principles of function. The handle has a central bore 22 located midway between the front and rear that penetrates the top and bottom of the handle and defines a spindle axis 94. The handle has a roll pin bore 26 located midway between the front and the central bore that penetrates the top and bottom of the handle. The handle has a longitudinal front bore 106 that defines a body axis 96 and communicates with both the roll pin bore and the central bore. The roll pin bore and the central bore are parallel to one another, and the roll pin bore and central bore are perpendicular to the front bore. The spindle axis is perpendicular to the body axis.

The central bore 22 of the handle 12 rotatably receives the top 48 of a rotating spindle 46. The top of the rotating spindle includes a top cylindrical flange 60 and a bottom cylindrical flange 58. The cylindrical flanges define a groove 62 between them to create a narrower neck portion of the spindle. An elongated shaft 98 is connected to the bottom cylindrical flange by a rounded shoulder portion 56. The bottom 50 of the elongated shaft defines a central bore 52 including an internal threaded portion 54. The internal threaded portion is adapted to threadedly interface with a cleaning rod connection sleeve 108.

The front bore 106 of the handle 12 receives the rear 32 of a tool drive spindle 28. The rear of the tool drive spindle has a fork with two prongs 36 having upper faces 100 and lower faces 102 that define a gap or slot 38 between them. The fork prongs act as a retention facility by receiving the neck portion of the rotating spindle 46 defined by groove 62 within the slot such that the upper and lower faces abut the cylindrical flanges 58, 60 of the rotating spindle 46. The close fit between the upper and lower faces and the cylindrical flanges enables linear force to be transferred from the handle to the cleaning rod attached to the rotating spindle to enable the forceful removal of bore obstructions from the rifle 74. The fork prongs also act as a retention facility that engages the rotating spindle to prevent the extraction of the rotating spindle from the handle while permitting the spindle to rotate freely within the central bore 22.

The front 30 of the tool drive spindle has a square element portion 40 that is adapted to engage a standard socket tool 64 of any common size. An intermediate cylindrical portion 34 connects the square element portion to the rear prongs 36. The cylindrical portion defines a roll pin bore 42. After the firearm maintenance tool 10 is assembled with the roll pin bore 26 and the handle axially registered with the roll pin bore 42 in the tool drive spindle, a roll pin 44 is inserted through both roll pin bores and acts as a retention element to secure the tool drive spindle against both longitudinal and rotational movement with respect to the handle.

To clear a bore obstruction from a rifle 74 using the firearm maintenance tool 10, the sectional cleaning rod 66 are assembled into a single length of cleaning rod, and are then subsequently joined to the shaft 98 of the rotating spindle 46 by the cleaning rod connection sleeve 108. A hand 88 of the user can directly grip the handle 12 of the firearm maintenance tool 10. Alternatively, if present, an optional vertical handgrip 68 can be detached from the lower Picatinny rail 82 of the rifle 74 and attached to the Picatinny rail segment 24 on the bottom 16 of the handle 12 by the rail clamp 74. A hand of the user can then grip the vertical handgrip instead of the handle 12 if doing so is more comfortable. The rear 92 of the upper receiver 76 is disengaged from the lower receiver 78 to expose the rifle's bore (not visible). The assembled cleaning rod can then be forcefully inserted through the length of the bore to clear any obstructions. The rotating spindle 46 rotates with respect to the handle so an optional brush attached to the end of the assembled cleaning rod can rotate as it follows the rifled bore down the barrel 104.

In the current embodiment, the handle 12 can be a unitary component made of, but not limited to: aluminum (hard coat anodized), stainless steel, steel, iron, polymers, carbon fiber or any material suitable for the application, and the tool drive spindle 28 and the rotating spindle 46 can be unitary components made of any suitable metal. The handle can be 0.750 inches tall and 2.15 inches long. The central bore 22 can have a diameter of 0.386 inch. The roll pin bore 26 can have a diameter of 0.125 inch. The front bore 106 can have a diameter of 0.377 inch.

In the current embodiment, the shoulder 56 of the rotating spindle 46 can have a radius of 0.10. The groove 62 can be 0.21 inch wide and can result in a neck thickness of 0.22 inch. The bottom and top cylindrical flanges 58, 60 can each have a thickness of 0.135 inch and a diameter of 0.375 inch. The rotating spindle can have a total length of 2.5 inches. The central bore 52 can have a diameter of 0.1968 inch, a total depth of 0.78 inch, and a smooth portion adjacent to the bottom 50 below the internal threaded portion 54 with a length of 0.225 inch. The internal threaded portion can have a pitch of 8-32 UNF, 8-36 UNF-2B, or any other suitable thread size.

In the current embodiment, the front square portion 40 of the tool drive spindle 28 can have a length of 0.50 inch and has a square cross-section that can be 0.375 inch per side. The roll pin bore 42 can be located 0.4850 inch behind the front square portion and can have a diameter of 0.129 inch. The fork prongs 36 can have a length of 0.452 inch, and the slot 38 between them can have a width of 0.225 inch and a radius of 0.25. The fork prongs can have a thickness of 0.2 inch. The tool drive spindle can have a total length of 1.830 inch.

Figure 8:
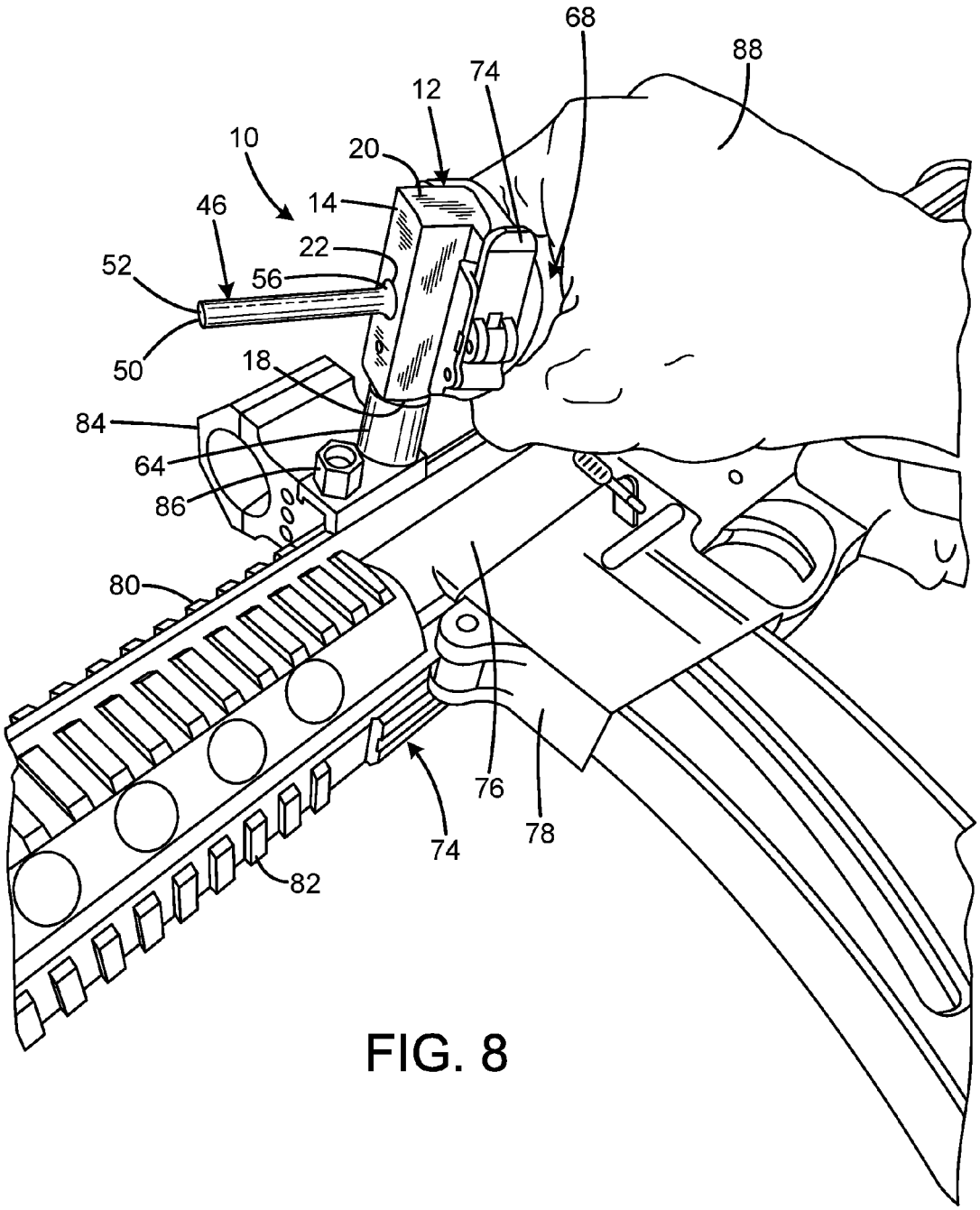
FIG. 8 is a top perspective view of the current embodiment of the firearm maintenance tool of FIG. 1 in use tightening a hex bolt on a rifle.

FIG. 8 illustrates the improved firearm maintenance tool 10. More particularly, the firearm maintenance tool 10 is shown in use as a wrench to adjust the tightness of a hex bolt 86 used to releasably secure an optical sight 84 to the upper Picatinny rail 80 of the rifle 74. The firearm maintenance tool can be used to tighten any compatible fastener to secure any desired accessory to a Picatinny rail. The cleaning rod connection sleeve 108 and sectional cleaning rod 66 have been detached from the rotating spindle 46 to make the firearm maintenance tool 10 as compact as possible. The optional vertical handgrip 68 is attached to provide the hand 88 of the user with as much leverage as possible to turn the tool drive spindle 28. A standard socket tool 64 adapted to fit the hex bolt 86 is releasably attached to the square portion 40 of the tool drive spindle.

While a current embodiment of a firearm maintenance tool has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm maintenance tool comprising:

a body including a rail mount segment; and a spindle rotatably mounted to the body and adapted to receive an elongated cleaning rod;

wherein the body defines a first aperture receiving the spindle, and a second aperture receiving a retention element operably securing the spindle to the body, preventing extraction of the spindle from the body, and enabling rotation of the spindle with respect to the body; and wherein the body is an elongated body defining a longitudinal body axis and the spindle extends perpendicularly from the body along a longitudinal spindle axis perpendicular to the longitudinal body axis.

2. The firearm maintenance tool of claim 1 wherein the tool includes a square drive element adapted to engage a tool socket.

3. The firearm maintenance tool of claim 1 wherein the body is an elongated body and wherein the rail segment extends the length of the body.

4. The firearm maintenance tool of claim 1 wherein the first and second apertures are perpendicular to each other.

5. The firearm maintenance tool of claim 1 wherein the body defines a retention element bore closely receiving and preventing the relative rotation of a retention element, the retention element being an elongated body having a first end including a protruding tool drive portion and an opposed second end having a retention facility engaging the spindle to prevent extraction of the spindle from the body.

6. The firearm maintenance tool of claim 5 wherein the retention facility is a fork defining a gap receiving a neck portion of the spindle, and having a face abutting a flange portion of the spindle.

7. The firearm maintenance tool of claim 5 wherein the tool drive portion is a square element adapted to engage a standard socket tool.

8. The firearm maintenance tool of claim 1 including a firearm handgrip removably mounted to the rail.

9. A firearm maintenance tool comprising:

an elongated body defining a longitudinal body axis and including a rail mount segment;

the body defining a spindle bore perpendicular to the longitudinal body axis;

a spindle rotatably received in the spindle bore and adapted to receive an elongated cleaning rod;

the body defining a retention element bore parallel to the body axis and communicating with the spindle bore;

an elongated retention element received in the retention element bore; and the retention element having a first end including a tool interface element and an opposed send end having a retention facility engaging the spindle and operable to prevent extraction of the spindle from the body, the retention facility being adapted to enable rotation of the spindle with respect to the body.

10. The firearm maintenance tool of claim 9 wherein the tool interface element is a square drive element adapted to engage a tool socket.

11. The firearm maintenance tool of claim 9 wherein the rail segment extends the length of the body.

12. The firearm maintenance tool of claim 9 wherein the retention facility is a fork defining a gap receiving a neck portion of the spindle, and having a face abutting a flange portion of the spindle.

13. The firearm maintenance tool of claim 9 including a firearm handgrip removably mounted to the rail.

14. The firearm maintenance tool of claim 9 wherein the spindle and the retention element are formed of steel, and the body is formed of a material less dense than steel.

15. A firearm maintenance tool comprising:

a body including a rail mount segment;

a spindle rotatably mounted to the body and adapted to receive an elongated cleaning rod;

wherein the body defines a retention element bore closely receiving and preventing the relative rotation of a retention element, the retention element being an elongated body having a first end including a protruding tool drive portion and an opposed second end having a retention facility engaging the spindle to prevent extraction of the spindle from the body; and wherein the retention facility is a fork defining a gap receiving a neck portion of the spindle, and having a face abutting a flange portion of the spindle.

* * * * *